US012188210B2

(12) United States Patent
Marquez Llinas et al.

(10) Patent No.: US 12,188,210 B2
(45) Date of Patent: Jan. 7, 2025

(54) CAPSULE FOR PROTECTING AN ELECTRONIC DEVICE INSIDE A WEAR ELEMENT OF AN EARTH MOVING MACHINE

(71) Applicant: METALOGENIA RESEARCH & TECHNOLOGIES S.L., Barcelona (ES)

(72) Inventors: Jordi Marquez Llinas, Terrassa (ES); Jordi Gavaldà I Monedero, Barcelona (ES); Ester Alonso Frigola, Celrà Girona (ES)

(73) Assignee: METALOGENIA RESEARCH & TECHNOLOGIES S.L., Barcelona (ES)

( * ) Notice: Subject to any disclaimer, the term of this patent is extended or adjusted under 35 U.S.C. 154(b) by 0 days.

(21) Appl. No.: 17/599,257

(22) PCT Filed: Mar. 27, 2020

(86) PCT No.: PCT/ES2020/058784
§ 371 (c)(1),
(2) Date: Sep. 28, 2021

(87) PCT Pub. No.: WO2020/201125
PCT Pub. Date: Oct. 8, 2020

(65) Prior Publication Data

US 2024/0052606 A1 Feb. 15, 2024

(51) Int. Cl.
*E02F 9/28* (2006.01)

(52) U.S. Cl.
CPC ..... *E02F 9/2883* (2013.01); *E02F 9/2816* (2013.01)

(58) Field of Classification Search
CPC ... E02F 9/26; E02F 9/264; E02F 9/267; E02F 9/268; E02F 9/28; E02F 9/2816;
(Continued)

(56) References Cited

U.S. PATENT DOCUMENTS 490,740 A * 1/1893 Cook ..... F16B 39/101 411/95
4,475,842 A * 10/1984 Onaya ..... F16D 1/093 403/370

(Continued)

FOREIGN PATENT DOCUMENTS

CN 117280100 A * 12/2023 ..... E02F 9/264
EP 3327205 A1 5/2018

(Continued)

OTHER PUBLICATIONS

Dimensionally Stable Plastics https://www.ensingerplastics.com/en-us/shapes/plastic-material-selection/dimensionally-stable#:~:text=The%20only%20polymer%20with%20zero,%2C%20PA12%2C%20PC%20and%20ABS. (Year: 2019).*

(Continued)

*Primary Examiner* — Jamie L McGowan
*Assistant Examiner* — Audrey L Lusk
(74) *Attorney, Agent, or Firm* — Calderone McKay LLC

(57) ABSTRACT

Capsule for protecting an electronic device inside a wear element of an earth moving machine, corresponding wear element and machine. The capsule has a central axis defining an axial direction, a front end, and a rear end. The capsule comprises a container, extending in the axial direction from said front end, provided with an inner chamber for housing said electronic device, and has a front part provided with a flange, and a rear part. The capsule also comprises a cover that can be removably coupled to said container and configured for covering said rear part of said container.

26 Claims, 8 Drawing Sheets

(58) Field of Classification Search
CPC ..... E02F 9/2808; E02F 9/2883; E02F 9/2833; E02F 9/2866; E02F 9/2825; B65D 2581/02; F16F 2230/08; F16F 2230/10
USPC ..... 37/452, 455, 456
See application file for complete search history.

(56) References Cited

U.S. PATENT DOCUMENTS

| | | | | |
|---|---|---|---|---|
| 8,890,672 | B2 * | 11/2014 | Miller | E02F 9/26 340/572.1 |
| 10,677,699 | B2 * | 6/2020 | Marquez Llinas | E02F 9/267 |
| 2009/0055293 | A1 * | 2/2009 | Mueller | G06Q 10/087 705/28 |
| 2013/0071213 | A1 | 3/2013 | Allouche et al. | |
| 2016/0237657 | A1 * | 8/2016 | Carpenter | E02F 9/267 |
| 2022/0025617 | A1 * | 1/2022 | Vallvé Bertran | E02F 9/267 |
| 2023/0349133 | A1 * | 11/2023 | Snyder | E02F 9/2808 |
| 2023/0407606 | A1 * | 12/2023 | Jordi | E02F 9/2883 |
| 2024/0011254 | A1 * | 1/2024 | Jordi | E02F 9/2883 |

FOREIGN PATENT DOCUMENTS

| | | | | |
|---|---|---|---|---|
| EP | 3992376 | A1 * | 5/2022 | B29C 31/00 |
| RU | 2749318 | C2 * | 6/2021 | E02F 9/26 |
| WO | 20120116408 | A1 | 9/2012 | |

OTHER PUBLICATIONS

Low Dielectric Constant https://www.degruyter.com/document/doi/10.1515/polyeng-2021-0338/html?lang=en#:~:text=Low%20dielectric%20polymer%20materials%20were,thermal%20stability%20and%20electrical%20insulation. (Year: 2021).*

Glass Fiber Filler https://www.polimapes.com/modified-pes-granule-with-30-glass-fiber-reinforcement.html#:~:text=This%20Glass%20Fiber%20Reinforced%20Plastic,the%20normal%20PES%20resin%20granules. (Year: 2021).*

International Search Report, PCT/EP2020/058784 Mailed Jun. 23, 2020.

* cited by examiner

CAPSULE FOR PROTECTING AN ELECTRONIC DEVICE INSIDE A WEAR ELEMENT OF AN EARTH MOVING MACHINE

FIELD OF THE INVENTION

The invention is comprised in the field of earth moving machines, for example, excavators, provided with replaceable wear elements that contact the earth to perform works, such as excavation works. In the field of the art, these wear elements are also known with the name ground engaging tools (GETs). They comprise elements such as:

- teeth: they have the function of penetrating the ground and protecting the blade of the excavator shovel;
- tooth holder: it has the function of protecting the blade and bearing teeth;
- front guards: they have the function of protecting the lip in the areas comprised between the teeth and also perform penetration function, but to a lesser degree than the teeth; and
- side guards: they protect the sides of the excavator bucket.

More specifically, the invention relates to a capsule for protecting an electronic device inside a wear element of an earth moving machine, having a central axis defining an axial direction, a front end, and a rear end opposite said front end in the axial direction. Electronic devices of this type are generally intended for monitoring operative parameters of the wear element, for example, for detecting accumulated wear of the element, for detecting the falling of said element, or for accumulating operation readings for subsequent analysis.

The invention also relates to a wear element comprising an electronic device protected by one of said capsules, and an earth moving machine comprising at least one of said wear elements incorporating said capsule.

STATE OF THE ART

In the sector of earth moving machines, wear elements, GETs, are starting to be provided with different types of electronic devices arranged therein. These electronic devices usually comprise sensors which are used to monitor or gather information about the operations of each wear element.

These wear elements are subjected to extreme working conditions: they are exposed to high pressures and end up withstanding high temperatures due to the friction of the wear element itself. For these reasons, there is a need to cover the electronic devices with a protective element, for example, a capsule intended for containing the electronic device. This capsule is formed complementary to an opening provided in the wear element intended for receiving the capsule.

Due to the working conditions, the capsule can end up with deformations which may even affect the electronic device. For example, dust or small particles of material are released during erosion or excavation works. These particles, known in the art as "fines," enter the exposed parts of the machinery, for example, in the attachment between the wear element and the part of the machine where said wear element is coupled, for example, between the attachment of a tooth and a tooth holder. Given that the wear end of the wear element is intended for wearing off with use, the capsule with the electronic device is usually located in the area of this attachment part between the wear element and the machine. The build-up of particles in this attachment part, together with the wear element repetitively hitting the ground during use, gradually compacts said particles, which increases pressure against the capsule and can end up deforming or even destroying it, affecting the device. Furthermore, due to their small size, the particles can also enter any inner cavity, for example, between the wear element and the capsule. All this hinders the use of electronic devices inside the wear elements.

Even if the capsule is robust enough to protect the electronic device, the effect of compacting the particles described above can end up applying so much pressure on the capsule that it is impossible to extract said capsule at the end of the service life of the wear element. The particles compacted between the wear element and the capsule also contribute to this problem, given that fines are compacted to a very high level of hardness retaining the capsule inside the wear element. This effect can be aggravated by possible capsule deformations which further hinder capsule extraction.

The fact that the capsule is fixed inside the wear element has several drawbacks. The main drawback lies in recycling, given that electronic components are not recycled the same way as the metallic material with which the wear element is manufactured. The recycling problem is particularly relevant in the case where the electronic device comprises some kind of battery. To solve this problem, one option is to destroy the capsule when use thereof has come to an end to enable extracting remnants of the destroyed capsule from inside the wear element. However, there is a risk that the batteries will end up being destroyed, which would release the contaminant products they contain.

Another drawback is the difficulty in recovering the electronic device, maintaining its integrity, when its service life has come to an end. That is particularly important for those devices that must be recovered, such as those that gather operation measurements of the wear element for subsequent study. Indeed, if the capsule and its contents are to be destroyed for extraction, the use of electronic devices of this type will be impossible.

There is therefore a need for a capsule which protects the electronic device during use of the wear element, and, where possible, allows recovering said electronic device when its service life has come to an end, maintaining the physical integrity of the electronic device during use, and, where possible, also during extraction. Another objective is to minimize recycling problems.

DESCRIPTION OF THE INVENTION

Unless specified otherwise, this document will make use of the coordinate system relative to the capsule described above and defined by said central direction, said front end, and said rear end. The skilled person will understand that the choice of the terms "front" and "rear" is used herein for the sake of clarity to establish a reference coordinate system. However, given the nature of the capsule and its usage positions, this choice of terms is, in fact, arbitrary and other terms could be used for the coordinates. In the naming convention used herein, references to the term "front" shall be understood to be relative to said front end, whereas references to the term "rear" are relative to said rear end. For example, when talking about the front end of an element of the capsule, it will refer to the end of the element closest to the front end of said capsule, whereas when talking about the rear end of an element of the capsule, it will refer to the end of the element closest to the rear end of said capsule. Concepts such as front part, rear part, front side, rear side, front face, rear face, etc., will be understood the same way. Moreover, the term "longitudinal" must be interpreted as being relative to the axial direction, but it may not be completely parallel to said direction. For example, it can be slightly oblique with respect to said axial direction.

The purpose of the invention is to provide a protective capsule of the type indicated above, which allows solving the problems described above.

This purpose is fulfilled by means of a capsule of the type indicated above, characterized in that it comprises:

- a container, extending in the axial direction from said front end, provided with an inner chamber configured for housing said electronic device, wherein said container has a front part provided with a flange, and a rear part; and
- a cover that can be removably coupled to said container and configured for covering said rear part of said container.

Splitting the capsule into an inner container and an outer cover covering the inner container provides the capsule with greater tolerance to the working conditions of the wear element. The cover of the invention is coupled to said container by means of any removable coupling means known in the art, such as a snap-fit or click-fit. Therefore, the possible deformations mainly affect the cover, whereas the inside of the container is less affected. In turn, the rear face of the flange is in contact with a support surface in the wear element. The flange at the front end therefore has the technical effect of attenuating the forces due to pressure exerted by the particles built up between the wear element and the machine, and deviating part of said forces to said support surface of the wear element instead of the capsule itself. Furthermore, it hinders the passage of particles to the contact areas between the capsule and the wear element, which further reduces the problems associated with compaction. The capsule is therefore more suitable for protecting the electronic device.

Preferred embodiments the features of which are set forth in the dependent claims have been provided based on the invention defined in the main claim.

Preferably, said flange has extraction means configured for extracting said container from said wear element. In this manner, even if the capsule cannot be extracted directly from the wear element, the extraction means allow extracting the container which is the part containing the electronic device. In this case, only the cover, instead of the whole capsule, would remain inside the wear element, unlike what occurs in the products of the known state of the art. This solution also favors the ability to maintain the integrity of the electronic device, even when the capsule is removed from the wear element.

Preferably, said extraction means are additionally configured for extracting said container from said cover. This further facilitates the extraction of the container: indirectly by means of extracting the container from the cover, and directly by means of extracting the container from the wear element. This minimizes the possibility of the container being lodged inside the wear element.

Preferably, said extraction means are configured for extracting said container by means of pushing in the axial direction, which facilitates a smooth extraction, minimizing the possibility of generating lateral pushes which may end up causing damage to the container or its contents, and which may furthermore cause it to become lodged during extraction.

Preferably, said extraction means comprise at least two threaded through holes, which allows extracting said container in the following manner:

- introducing a screw into each of said threaded through holes, said screw having a thread complementary to the thread of said threaded through hole;
- screwing in each screw at least partially, causing an axial push; and
- repeating the screwing in step until the push of said screws causes the extraction of said container.

Generally, when more threaded holes are provided, the force equilibrium that can be obtained during extraction will be greater, so said extraction is smoother. In contrast, with more threaded holes, the flange will have less structural integrity and the extraction will require more steps given that more screws must be tightened. Preferably, said extraction means comprise three threaded through holes, such that an optimum trade-off is obtained between the conditioning factors described above.

Preferably, said threaded holes are arranged in the axial direction parallel to said central axis, which allows extraction by means of axial pushes, such that said extraction is smoother.

Preferably, said threaded holes are all arranged at the same distance from said central axis, preferably separated from one another at regular intervals, which allows a homogeneous force equilibrium during extraction. The skilled person will understand that regular intervals refer to fact that the threaded holes, which are contiguous in a circumferential direction with respect to the central axis, are arranged at the same distance from one another. For example, in the case of a circumferentially symmetrical flange with three holes, each of these holes would be located at 120°.

Preferably, said container is open at its rear end, which facilitates the introduction of the electronic device in the capsule, given that the capsule does not have to be molded around said electronic device. Therefore, it is possible to introduce the electronic device in the container and then cover the container with the cover, thereby closing the compartment containing the electronic device.

Preferably, the capsule has a diameter with respect to said central axis that decreases, preferably in a uniform manner, between said front end and said rear end of said capsule, facilitating both the introduction of the capsule in and the extraction thereof from the device.

Preferably, the capsule has a frustum shape such that the inner part thereof can house the device, minimizing at the same time the length in the axial direction. Preferably, the capsule has a frustoconical shape which simplifies the design and facilitates extraction, particularly if the capsule did not undergo deformations.

Preferably, the capsule further comprises first positioning means configured for cooperating with respective positioning means of said wear element for positioning said capsule inside said wear element. This is particularly advantageous when the capsule must be positioned in a specific position with respect to the wear element, for example, in the case where the electronic device comprises elements that require specific relative positions. Preferably, said positioning means of said capsule comprise the outer shape of said capsule, and said respective positioning means of said wear element comprise an opening intended for receiving said capsule having a shape complementary to the shape of said capsule.

In an advantageous embodiment, said first positioning means are provided on said flange. This has the advantage of being able to create capsules with circumferentially symmetrical shapes with respect to the central axis, and at same the time precisely positioning the capsule in the wear element. In the case where the opening of the wear element where the capsule is introduced is made by machining, the use of circumferentially symmetrical shapes also simplifies machining. Preferably, said positioning means comprise the shape of the flange, particularly for an advantageous embodiment in the case of a capsule with circumferential symmetry, the flange is in the form of a circumference with a substantially straight arch on its periphery acting as positioning means by means of the complementary shape in said wear element. Other preferred shapes have other positioning means such as recesses or notches intended for the same function.

Preferably, said capsule further comprises second positioning means configured for cooperating with respective positioning means of said electronic device for positioning said electronic device inside said capsule. This is advantageous when said electronic device must be positioned in a specific manner with respect to the capsule. It is particularly advantageous in combination with said first positioning means of said capsule with respect to said wear element. Indeed, in these cases, the combination allows a precise positioning of the electronic device inside the wear element, which may be required for the case where the device has elements such as positioning sensors, directional antennas, etc. Preferably, said second positioning means comprise a rib in the axial direction configured for fitting into a groove complementary to said rib provided in said electronic device.

Preferably, said capsule further comprises capsule fixing means configured for fixing said capsule to said wear element. The presence of extraction means allows using the fixing means which would otherwise hinder the extraction of the capsule. Therefore, safety is improved and the risk of the capsule falling during transport is minimized.

Preferably, said capsule fixing means comprise projections provided on the perimeter of said flange, which allows snap-fitting into the part of the flange. Preferably, said projections are longitudinally arranged, perpendicular to said perimeter. Therefore, in the case where the flange is substantially cylindrical, said projections extend in the axial direction, parallel to the central axis. If the flange has a frustum shape, the projections are arranged in a longitudinal manner, but oblique to the axial direction. This arrangement facilitates the insertion and extraction of the capsule while at the same time providing a level of coupling suitable for common wear element handling operations.

Preferably, said capsule is manufactured in a polymer material, which facilitates its manufacture and minimizes costs, while at the same time providing a suitable level of protection. Preferably, said material is biodegradable such that in the event that the cover cannot be removed, it will break down, minimizing the environmental impact. Preferably, the material used to manufacture the capsule has a water absorption of less than 10% measured according to the norm ISO 62:2008 published on February 2008. Due to the working conditions, the wear element is sometimes exposed to water. For example, due to the climatic conditions or the water accumulated in the ground that is being engaged. Water absorption can alter the physical and/or the electrical characteristics of the material of the capsule. This can lead to undesired consequences like a decrement of the ability of the capsule to support physical stress, changes in size (bloating), etc. In addition, if the device contained in the capsule needs external communication, for example using electro-magnetic fields, changes in electrical conductivity due to the water absorption can lead to higher levels of attenuation, thereby deteriorating said communication. Preferably the water absorption is less than 1%, and more preferably less than 0.5%, further minimizing the aforementioned effects.

Preferably, said material has a moisture absorption of less than 4%, measured according to the norm ISO 62:2008 published on February 2008. Environment moisture can also be absorbed by the material leading to effects equivalent to those of water. Moisture levels can have a great variability in different locations, in particular, between the place of manufacture of the capsule or the wear element, and the place where the earth moving machine is operating. Therefore, minimizing the amount of moisture absorption is particularly relevant in order to grant the quality of the capsule and its contained device. Preferably, said moisture absorption is less than 0.2%, further minimizing the aforementioned effects.

Preferably, said material has a dielectric constant equal or less than 5, preferably, equal or less than 4, which is particularly advantageous for the cases where the device protected by the capsule is provided with an antenna for external communications. This kind of elements often need impedance matching and it has been found that it can be adversely affected by the dielectric characteristics of the material of the capsule.

Preferably, said material has a dielectric loss coefficient equal or less than 0.03, preferably, equal or less than 0.005, in order to minimize the dissipation of electromagnetic energy which is particularly advantageous when the capsule contains a device that uses electromagnetic energy to communicate with the exterior, for example, for sending or receiving information.

Preferably, said material comprises at least one of the list consisting in:

polyamide 6, PA6;
polyamide 6.6, PA6.6
polyether ether ketone, PEEK; and
polyphenylene sulfide, PPS.

PA6 and PA6.6, also referred as PA66 or PA6,6, are widely used polymers having advantageous mechanical and dielectric characteristics. Typically, PA6 has a dielectric constant of 3.2 and a dielectric loss coefficient of 0.026. PEEK typically has the same dielectric constant as PA6, ie. 3.2, but a much lower dielectric loss coefficient, about 0.004. In addition, PEEK has a low water and moisture absorption, respectively 0.5% and 0.1%, thus having the aforementioned advantages. PPS has a very low water absorption, around 0.02%. Moisture absorption is negligible for PPS.

Preferably, said material further comprises a glass fiber filler. Glass fiber fillers, often referred as GF, confer advantageous characteristics to the polymeric materials. In particular, adding a glass fiber filler allows preventing brittle behavior in cold environments, and significantly reduce the softening behavior of the polymers that typically occurs at high temperatures. Said softening is particularly relevant at high temperatures compared to ambient temperature conditions because the polymers are often in constant deformation even at lower stress levels. These two technical effects are particularly relevant since the capsule is exposed to working or environmental conditions that can typically range from −50° C. to 200° C. Therefore, adding a glass fiber filler improves the robustness of the capsule in the whole range of temperatures to which the capsule is exposed. Besides, adding glass fiber also typically improves the dielectric behavior since the resulting material often has a lower dielectric loss coefficient. In addition, the glass fiber filler decreases the water and/or moisture absorption. Therefore, adding a glass fiber filler to the polymeric material is particularly advantageous for manufacturing the capsule of the invention. Preferably, the material has 30% by weight of glass fiber filler, which is a common percentage in the market offered by the manufacturers of polymers. As an example, a common notation for a PPS polymer with 30% of added glass fiber filler is PPS+30% GF.

Preferably, said container and said cover are configured so that when said cover is coupled to said container said cover covers said container up to the rear end of said flange. During the extraction operation from the wear element, the container slides inside the cover and said sliding movement is between two materials with small friction, for example, plastic materials, instead of sliding along the metal material of the wear element. Therefore, the extraction is facilitated due to a decrease of friction.

In an alternative embodiment, said container and said cover are configured so that when said cover is coupled to said container said cover is spaced from said flange. The spaced section of the container can thus have a thicker wall without incrementing the external volume of the capsule. This configuration is particularly advantageous in the case where the inner chamber extends in the flange part of the container. In these cases, the capsule is debilitated in the walls near the front end of the inner chamber. Providing a thicker wall section in this zone improves the strength of the capsule. Preferably, the container comprises a wall part provided in the spacing between the rear end of the flange and the cover, which is preferably configured to follow the shape of the cover.

Preferably, said rear part is an oval base frustum. In the context of this invention the term "oval" or "oval shape" stands for closed curves that resemble circles flattened in one of its axis, for example, ovals, ellipses, stadiums or the like, being regular and irregular. The frustum shape extends in said axial direction. Said slim and flattened shape facilitates the incorporation of the capsule in wear elements having a flat shape. In addition, the frustum shape facilitates the extraction of the capsule from the wear element. Finally, the shape also facilitates the orientation of the capsule, therefore acting as positioning means.

Preferably, said flange is an oval base frustum, extending in said axial direction, thus having equivalent advantages that the case of the rear part described above.

Preferably, said capsule further comprises a metal washer arranged at the rear end of said flange, so that said metal washer is interposed between said flange and said wear element when said capsule is inserted in said wear element; said washer having at least two threaded through holes. Said holes are preferably provided at opposite ends of the washer, and have the equivalent function as the extraction means of the flange that have been described above. The skilled person will understand that providing more than two holes facilitates the extraction but weakens the washer, in particular if the holes are too close to one another. Therefore, said skilled person will have no problems in deciding the number of threaded holes in the washer depending on the size and shape of said washer. Providing a metal washer with threaded through holes solve the problem of deformations in the holes of the washer due to the harsh working conditions. Said deformations can lead to unusable threaded holes that could difficult the extraction of the capsule from the wear element. In the cases where the threaded holes are provided in the flange, deformations occur more easily, since that flange is often made of a softer material. Nevertheless, said softer materials such polymers are advantageous since they provide a good thermal and shock isolation for the device inside the capsule. The usage of a separate metal washer solves the issue of extraction without limiting the desired isolation level. In some alternative embodiments, metal inserts are used instead of a metal washer, nevertheless, the washer is a preferred embodiment because it facilitates the distribution of the extraction forces.

Preferably, said flange extends over said threaded through holes, said flange provided with corresponding access holes for accessing said threaded through holes from the front end of said flange. Therefore, the surface contacting the flange with the metal washer is maximized, thus facilitating the extraction operation.

In alternative embodiment, said flange does not extend over said threaded through holes, thus minimizing the possibility that deformations in the flange due to the harsh working conditions could block the access to the threaded holes in the metal washer.

The invention also relates to a wear element, GET, comprising an electronic device protected by a capsule according to any of the embodiments indicated above. The capsule is preferably arranged in an opening located inside the wear element.

The invention also relates to an earth moving machine comprising at least one wear element of the type described above. Preferably, said machine is an excavator comprising a shovel provided with several of said wear elements.

The invention also covers other detail features illustrated in the detailed description of an embodiment of the invention and in the attached drawings.

BRIEF DESCRIPTION OF THE DRAWINGS

The advantages and features of the invention can be seen from the following description in which preferred embodiments of the invention are described in a non-limiting manner with respect to the scope of the main claim in reference to the drawings.

FIGS. 7 and 8 show perspective views, FIG. 9 shows a view from the rear end, and FIG. 10 shows a section view. The place where the section is performed is labeled with a horizontal line in FIG. 9.

FIG. 17 contains several views of an embodiment of the capsule having a metal washer.

FIG. 18 contains several views of another embodiment of the capsule having a metal washer.

DETAILED DESCRIPTION OF SEVERAL EMBODIMENTS OF THE INVENTION

Figure 1:
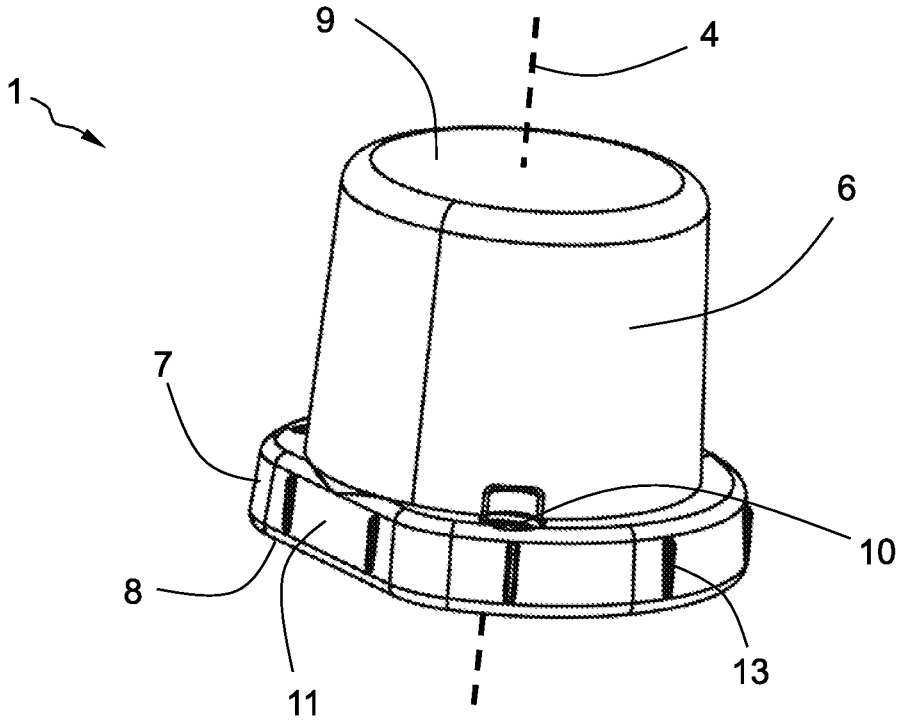
FIG. 1 is a perspective view of a capsule according to one embodiment.
Figure 2:
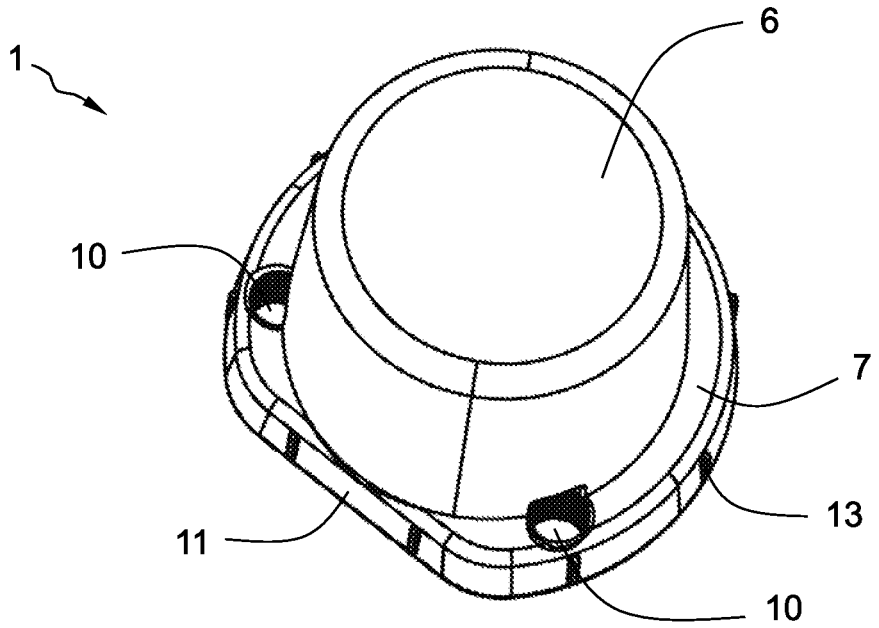
FIG. 2 shows another perspective view of the same capsule of FIG. 1.
Figure 3:
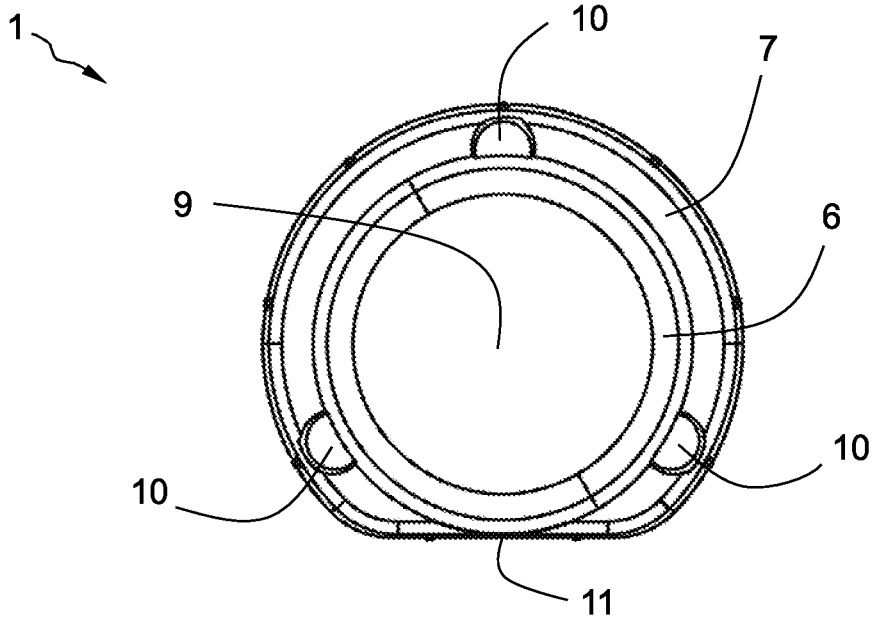
FIG. 3 is a view of the capsule according to the invention from the rear end.

The drawings show an embodiment of a capsule 1 for protecting an electronic device 2 inside a wear element 3 of an earth moving machine. It can be seen in FIG. 1 that the capsule 1 has a central axis 4, represented by a discontinuous line. Said central axis 4 defines an axial direction. The capsule also has a front end 8 and a rear end 9 opposite said front end 8 in the axial direction. As indicated above, the terms "front" and "rear" are used only as a naming convention for describing the coordinates relative to the capsule 1 itself, given that it can be in different positions during use, storage, and transport.

Figure 4:
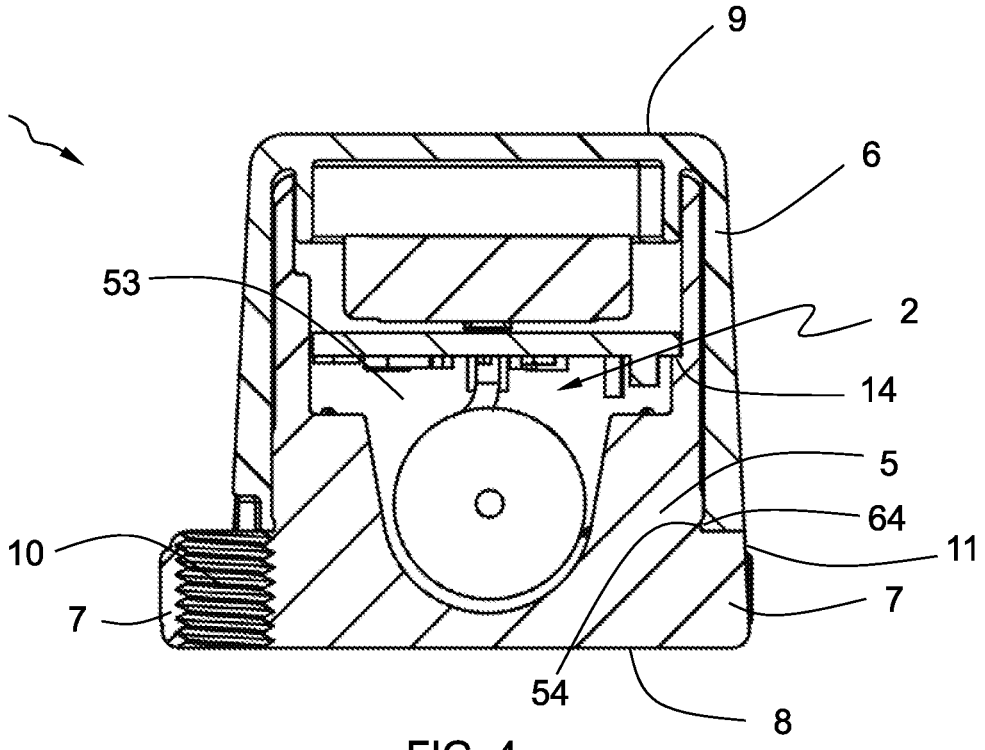
FIG. 4 is a section of a capsule according to the invention, protecting an electronic device.
Figure 5:
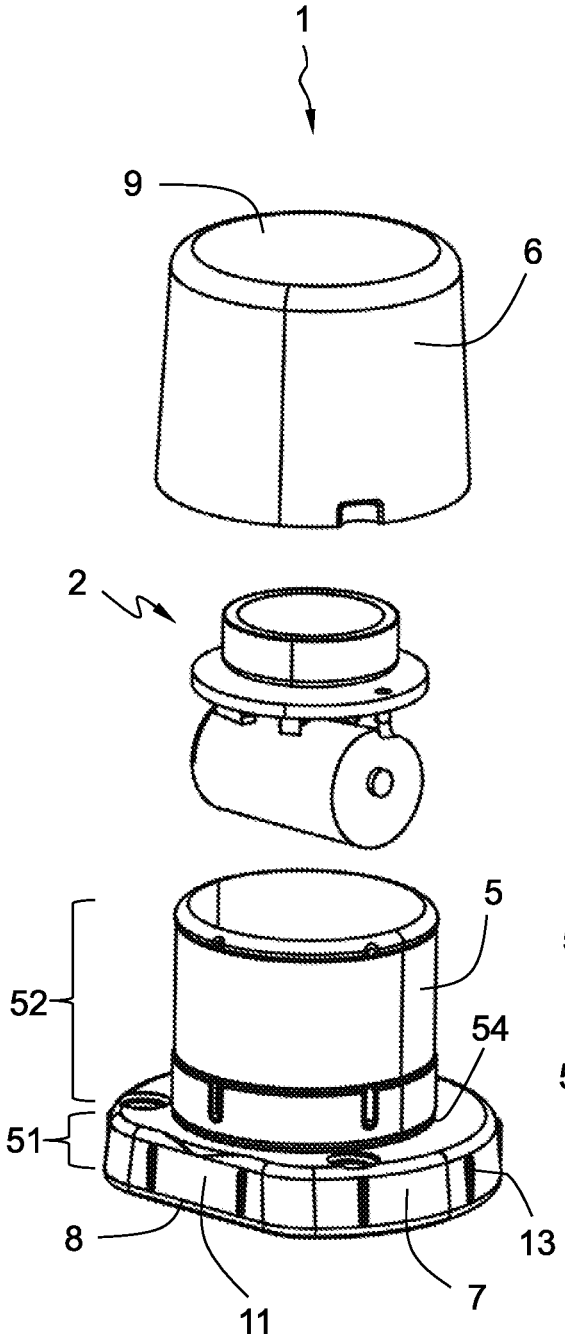
FIG. 5 is an exploded view of a capsule according to the invention, with an electronic device to be protected by the capsule.
Figure 6:
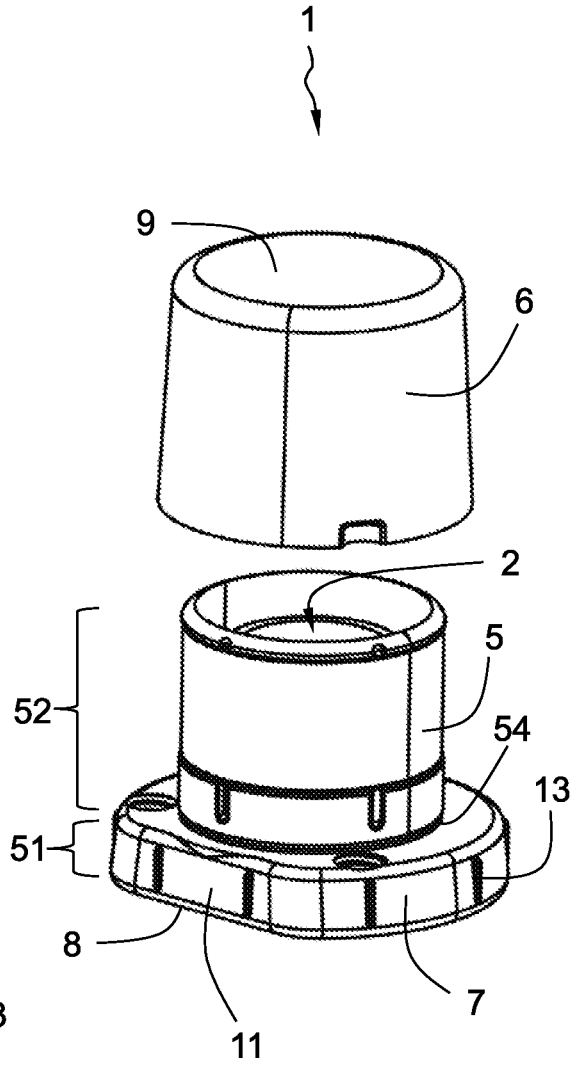
FIG. 6 shows the capsule of FIG. 5 in which the electronic device has already been introduced in the container.
Figure 11:
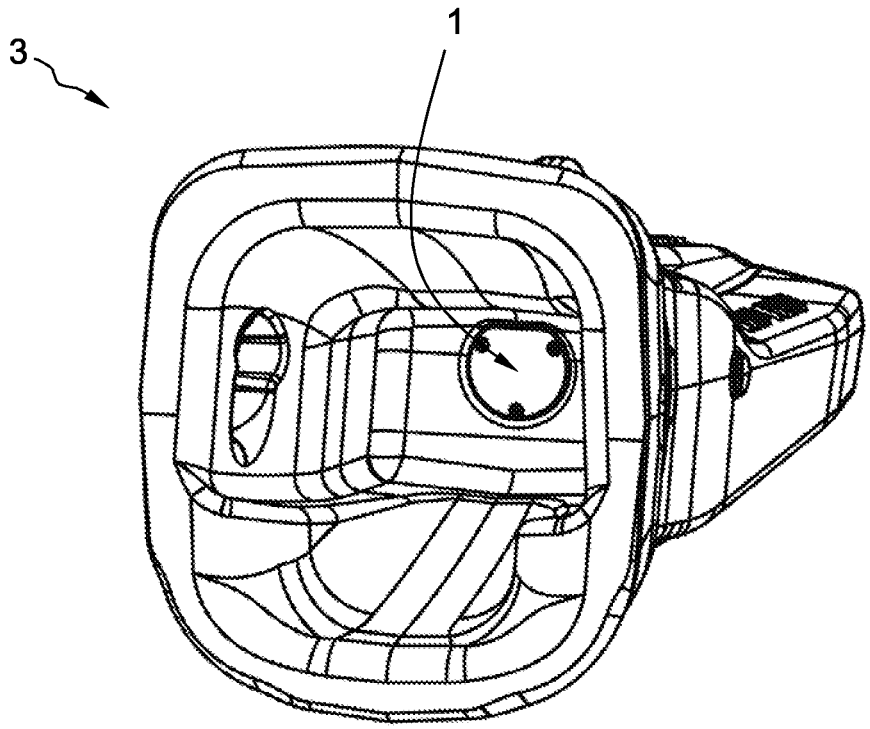
FIG. 11 shows a perspective view of a wear element having incorporated therein a capsule according to the invention, in which the front end of said capsule can be seen.
Figure 12:
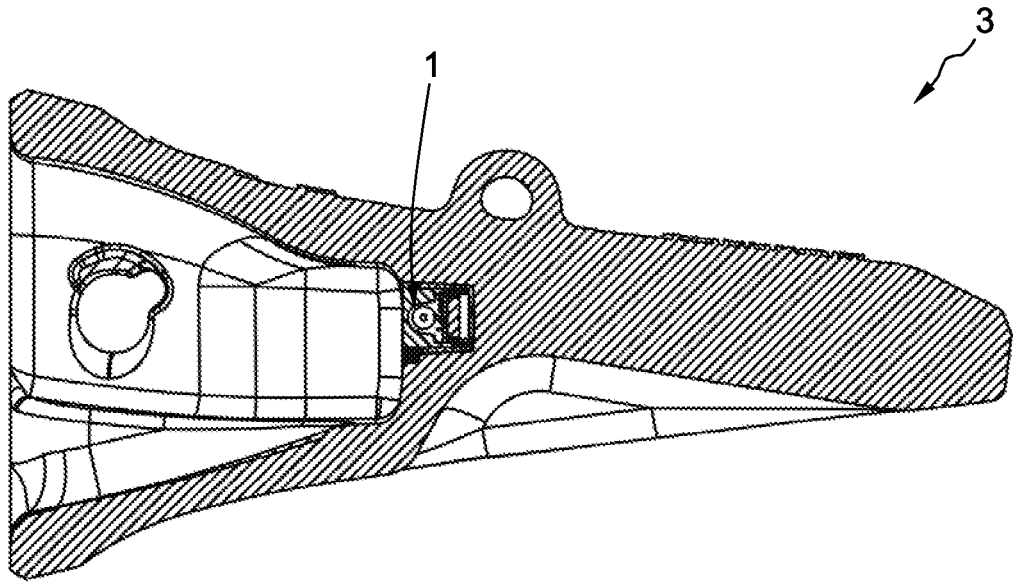
FIG. 12 is a section of the wear element of FIG. 11.

The capsule 1 with the electronic device 2 is shown in FIGS. 4, 5, and 6. FIG. 5 shows an exploded view of the capsule 1, FIG. 6 shows the capsule 1 not yet closed but with the electronic device 2 already introduced therein. FIG. 4 shows a sectional view of the capsule 1 assembled with the electronic device 2 inserted therein. Moreover, FIGS. 11 and 12 show the capsule 1 inside a wear element 3 of an earth moving machine. These wear elements 3 are also known as GETs.

Figure 7:
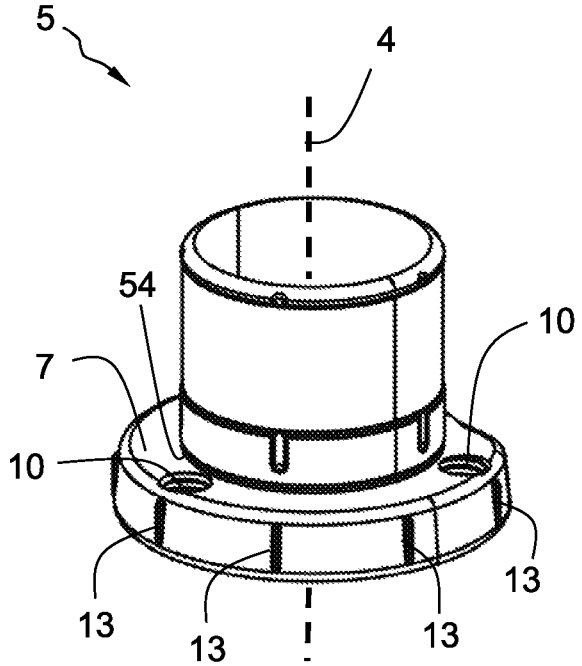
FIGS. 7, 8, 9, and 10 show different views of the container of the capsule according to one embodiment.
Figure 8:
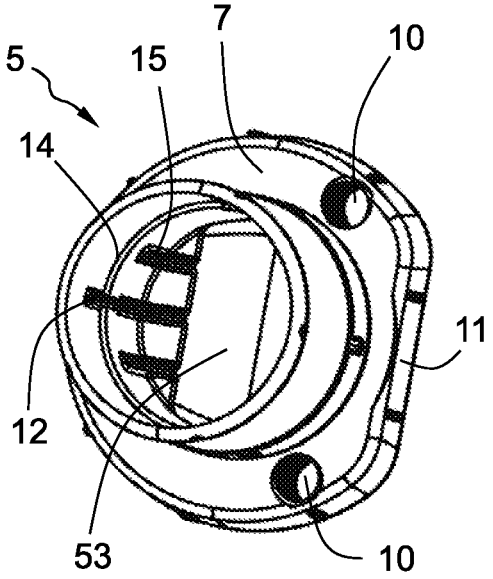
Figure 9:
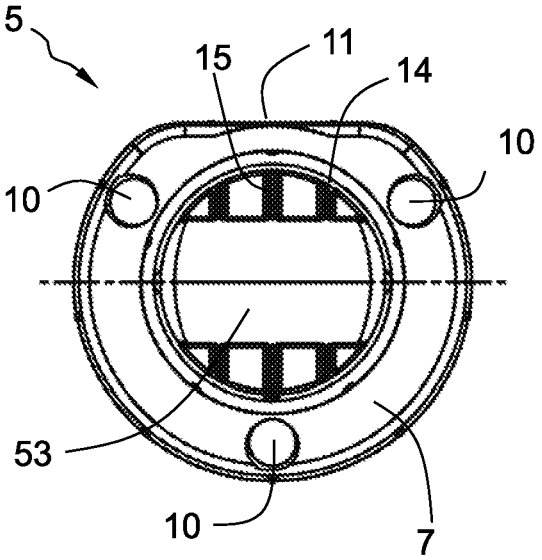
Figure 10:
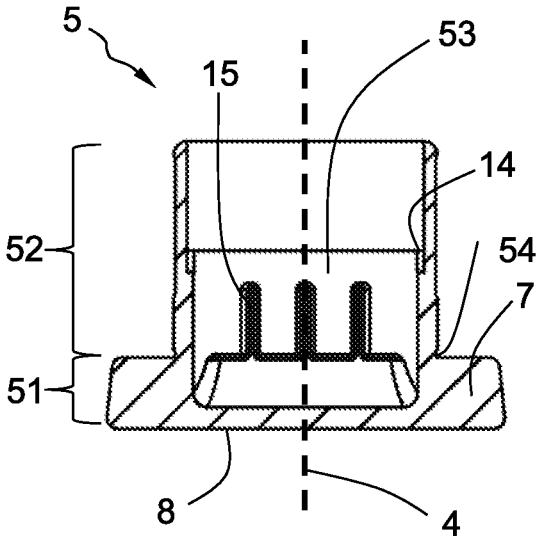

The capsule 1 of the drawings comprises a container 5 shown separately in FIGS. 7 to 10. As shown in FIG. 7, said container 5 extends in the axial direction from said front end 8 of the capsule 1, such that the front end of the container 5 corresponds to the front end 8 of the capsule. The container 5 is provided with an inner chamber 53 configured for housing said electronic device 2. FIGS. 5, 6, and 10 show that said container 5 has a front part 51 and a rear part 52, the front part 51 being provided with a flange 7. For the example, both front part 51 and rear part 52 are integrally attached forming single body, particularly they are manufactured as a single part.

For the example of the drawings, the container 5 is open at its rear end such that the electronic device 2 can be introduced into said container 5 through its rear end. In other embodiments, the rear end of the container 5 is not open.

The capsule also comprises a cover 6 that can be removably coupled to said container 5 and configured for covering said rear part 52 of said container 5. For the example, the rear part 52 of the container 5 has an annular recess 54 in the area where it is attached with the front part 51. In turn, the cover 6 has an annular protuberance 64 at its front end. Said annular recess 54 and said annular protuberance 64 cooperate with one another as coupling means, allowing the cover 6 to be removably coupled to the container 5. Other embodiments have several of said annular recesses in the rear part 52 and several corresponding annular protuberances in the cover 6, thereby achieving a stronger coupling. Other embodiments have other types of coupling between the cover 6 and the container 5.

Therefore, in the examples of the drawings, the cover 6 covers the container 5 right up to the rear end of the flange 7: the container 5 can be inserted into the cover 6 and said cover 6 acts like a cap, tightly covering the container 5. A section view showing the interaction and the relative positions between the container 5 and the cover 6 can be seen in FIG. 4. It is seen in the same FIG. 4, and separately in FIG. 10, that the rear part 52 of the container 5 has a cylindrical tubular shape, whereas the cover 6 has a frustum shape, particularly a frustoconical shape which facilitates the extraction of the capsule from inside the wear element 3. This embodiment allows the capsule 1 to have a diameter with respect to the central axis 4 that decreases between the front end 8 and the rear end 9. Other embodiments have other profile types, for example, partially staggered profiles, profiles having a frustum shape but without circumferential symmetry, etc.

For the embodiment of the drawings, said flange 7 has extraction means 10 configured for extracting said container 5 from said wear element 3. Other embodiments do not have extraction means 10.

For the example of the drawings, the extraction means 10 comprise three threaded through holes in the axial direction located at regular intervals of 120° and at the same distance from the central axis 4, all of them being parallel to said central axis 4, as shown in FIG. 9. Once the capsule 1 is inserted in the wear element 3, said through holes are arranged facing the wear element 3 on the support surface for the flange 7. In this manner, extraction from inside the wear element 3 comprises introducing screws into said through holes and screwing them in. When the screws contact the wear element 3, an axial push which allows extracting said container 5 from the wear element 3 is produced. Indeed, for this example, as each screw is being screwed in for the extraction operation, said screw first contacts the support surface for the flange of the wear element 3, and as the screwing in continues the axial push which starts to separate the container 5 from the wear element 3 is initiated. As each screw continues to be screwed into the threaded hole, the extraction continues until said container 5 is completely extracted. In the case where the cover 6 has been fixed to the wear element 3, this extraction also separates the container 5 from the cover 6.

For some embodiments such as the one shown in the drawings, the capsule 1 further comprises first positioning means 11 configured for cooperating with respective positioning means of said wear element 3 for positioning said capsule 1 inside said wear element 3. FIG. 11 shows the capsule 1 inserted into the wear element 3. The way in which said first positioning means 11 are provided on said flange 7 and comprise the shape of the flange 7 can be seen in said figure, for the case of the example. In particular, the flange 7 of the example is in the form of a circumference with a substantially straight arch on the periphery thereof acting as first positioning means 11. It can be seen in FIGS. 2, 3, 8, and 9 that said arch is arranged between two of the through holes. Therefore, given that the wear element 3 has a complementary shape, the capsule 1 can only be inserted into the wear element 3 in a specific position. Other preferred shapes have other positioning means such as recesses, notches, or even combinations thereof.

In some embodiments like the one shown in FIGS. 8, 9, and 10, the capsule 1 further comprises second positioning means 12 configured for cooperating with respective positioning means of said electronic device 2 for positioning said electronic device 2 inside said capsule 1. FIG. 8 shows a perspective view in which the inner chamber 53 of the container 5 can be seen. For the example, the chamber 53 has an annular rim 14 on which the electronic device 2 is supported when it is arranged inside the capsule 1. The same drawing also shows an axial rib acting as second positioning means 12, cooperating with an axial groove provided in the electronic device 2. Other embodiments have other types of positioning means 12, for example, based on the geometry of the electronic device 2 or on elements expressly provided for such purpose.

FIGS. 8, 9, and 10 also show how, for the embodiment of the example, the inner chamber 53 has reinforcement ribs 15. For the sake of clarity, only some of said reinforcement ribs 15 have been marked with reference numbers in the drawings.

In some advantageous embodiments like the one shown in the drawings, the capsule 1 further comprises capsule fixing means 13 configured for fixing said capsule 1 to said wear element 3. In particular, for the example said capsule fixing means 13 comprise scores provided on the perimeter of said flange 7, arranged perpendicular to said perimeter. In the example, given that the flange has a slightly frustoconical profile, the scores extend axially, not completely parallel to the central axis 4, but rather slightly oblique thereto.

In some embodiments, the capsule 1 is manufactured in a polymer material such as polyamide. In other embodiments, the capsule is manufactured in polyamide with glass fiber filler, particularly PA6.6+30% GF. In other embodiments, the material is biodegradable.

In the embodiments shown in the FIGS. 1 to 18, the capsule 1 is made of PPS+30% GF. This material has an 0.02% water absorption and a negligible moisture absorption, both measured according to the norm ISO 62:2008. Dielectric constant is 4 and dielectric loss coefficient is 0.004.

In other embodiments, the capsule 1 is made of PA6, PA6.6 or PEEK. In some of the embodiments, the material also includes a glass fiber filler. Some of the latter include a 30% by weight of glass fiber filler.

Figure 13:
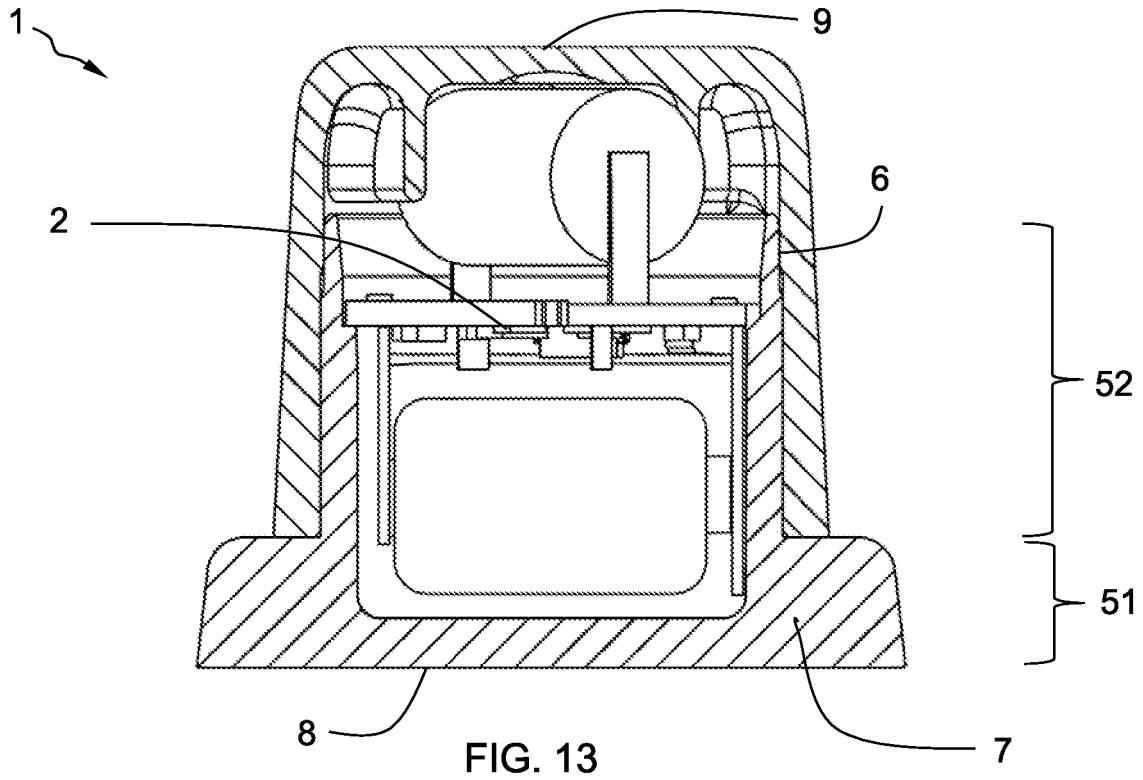
FIG. 13 is a section view of an embodiment of the capsule according to invention.
Figure 14:
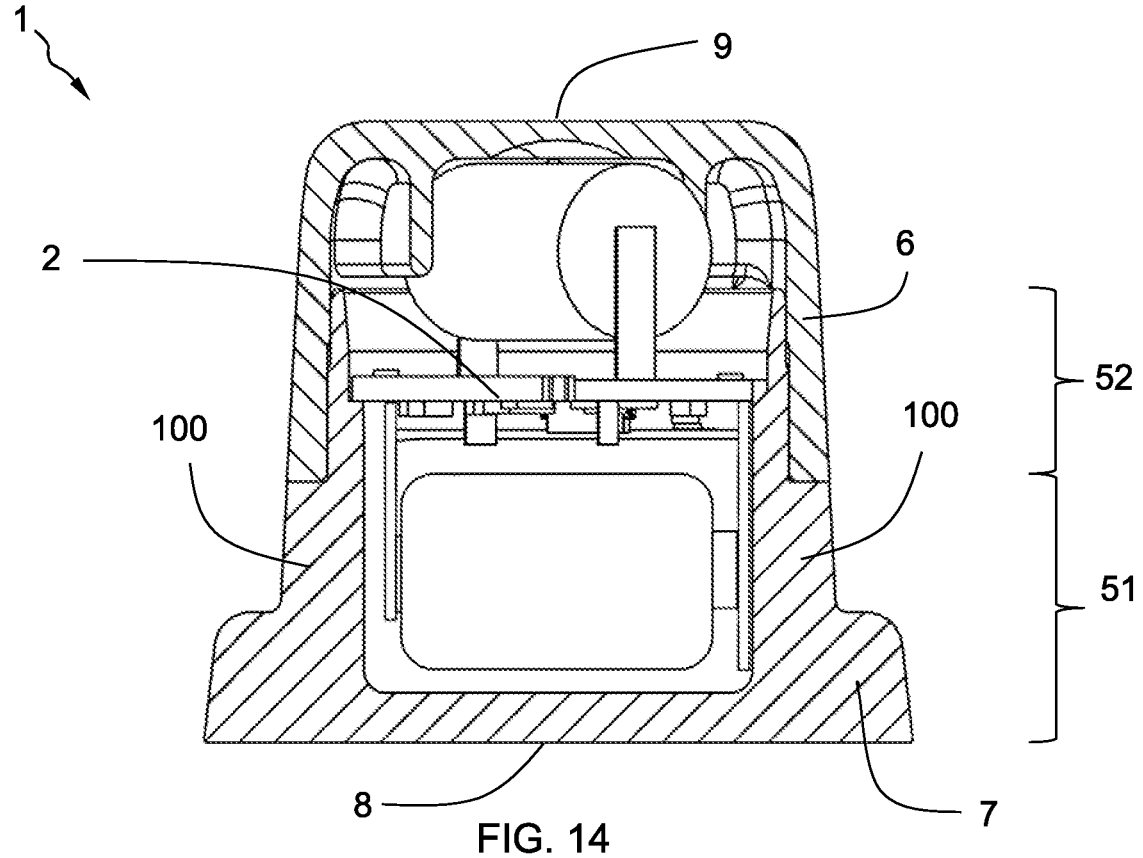
FIG. 14 is a section view of another embodiment of the capsule.

FIGS. 13 and 14 show two alternative embodiments of the capsule 1. In the embodiment shown in the FIG. 13, the container 5 and the cover 6 are configured so that, when the cover 6 is coupled to the container 5, the cover 6 covers the container 5 up to the rear end of said flange 7. The same feature is present in the embodiments shown in FIGS. 1 to 12.

By contrast, FIG. 14 shows an embodiment where the cover 6 is spaced from said flange 7 when the cover 6 is coupled to the container 5. In this embodiment, the container 5 comprises a wall part 100 provided in the spacing between the rear end of the flange 7 and the cover 6. The wall part 100 is considered to belong to the front part 51 of the container 5 in the embodiment shown in this figure.

Figure 16:
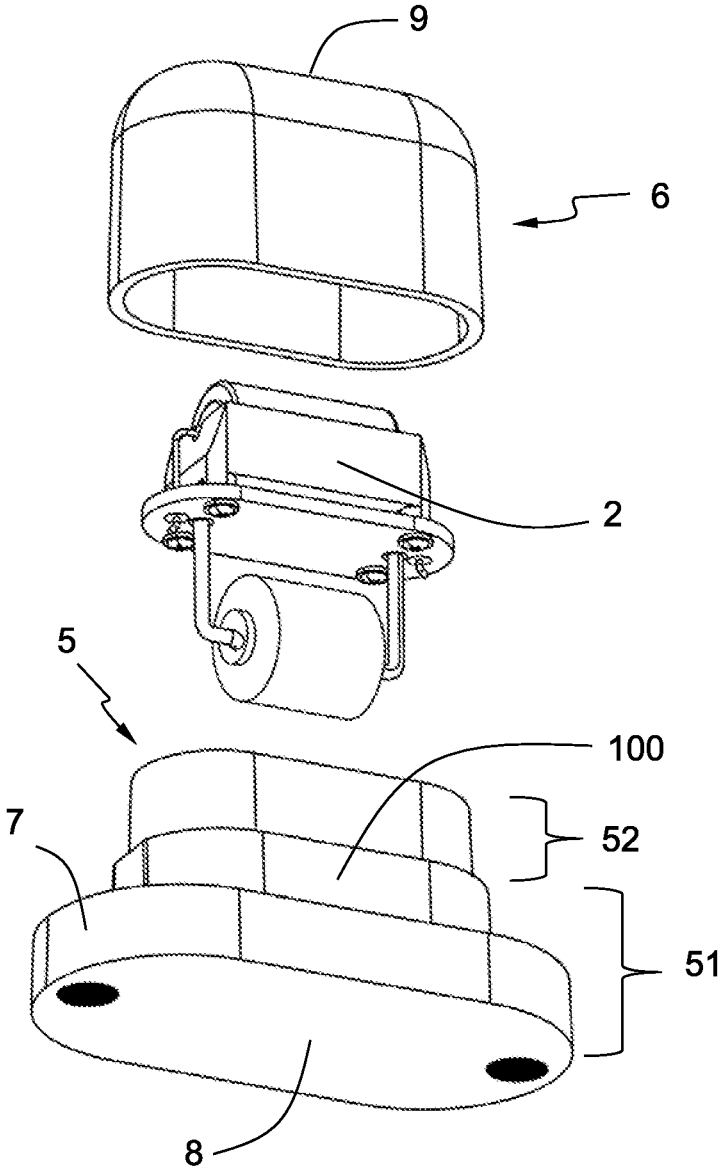
FIG. 16 is an exploded view of the capsule of FIG. 15.
Figure 15:
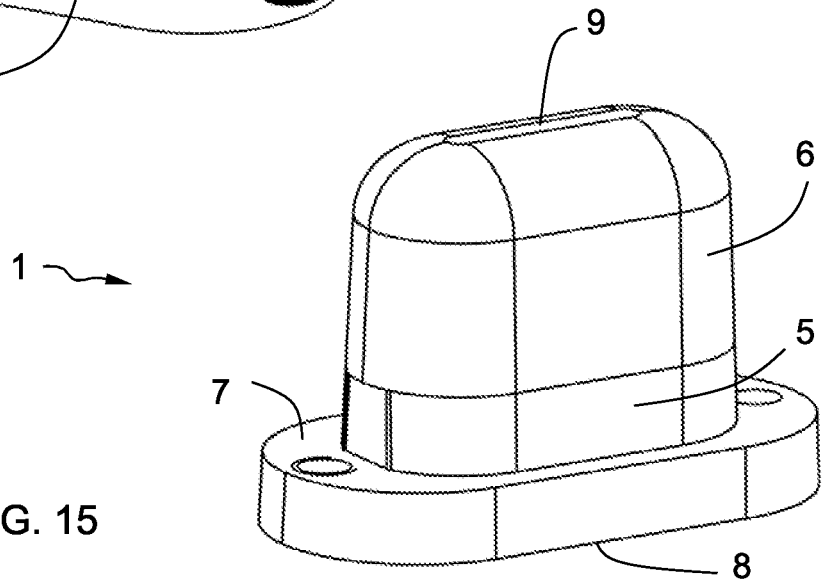
FIG. 15 is a perspective view of an embodiment of the capsule having a flattened shape.

FIGS. 15 and 16 show another embodiment of the capsule 1 according to the invention wherein the rear part 52 of the container 5 is an oval base frustum, thus having a slim and flattened shape compared to that of the frustoconical capsule of the first embodiment. The cover 6 has a shape complementary to the container 5, therefore, it also has a part having an oval base frustum shape, and a rounded end part at its rear end 9. In the embodiment, the flange 7 is an oval base frustum. In this embodiment, the flange 7 is also an oval base frustum.

Figure 17A:
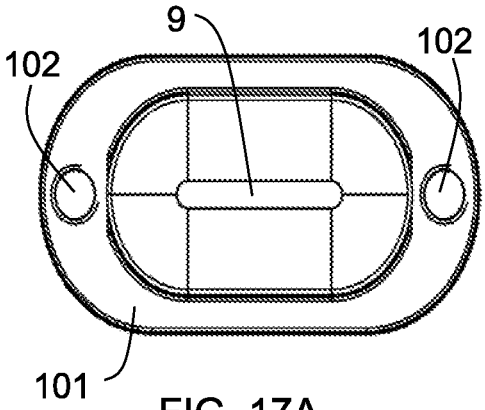
FIG. 17A is a view from the rear end.
Figure 17B:
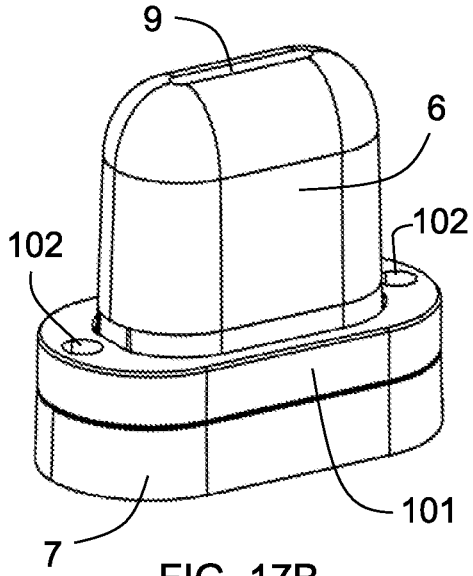
FIG. 17B is a perspective view and FIG. 17C is a view from the front end.
Figure 17C:
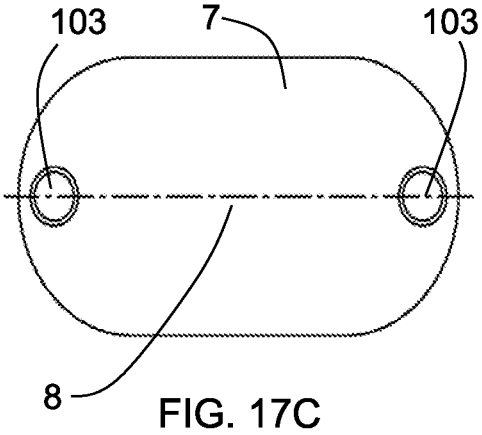

The FIGS. 17A, 17B and 17C show another embodiment of the capsule 1 according to the invention, further comprising a metal washer 101 arranged at the rear end of said flange 7. When the capsule 1 is inserted in the wear element 3, said metal washer 101 is interposed between the flange 7 and the wear element 3. In the case of the embodiment, the washer 101 has two threaded through holes 102 at opposite ends of the washer along the longitudinal axis represented by a dashed line in FIG. 17C. In this embodiment, the flange 7 extends over the two threaded through holes 102, but the flange 7 is provided with corresponding access holes 103 for accessing said threaded through holes 102 from the front end of said flange 7.

Figure 18A:
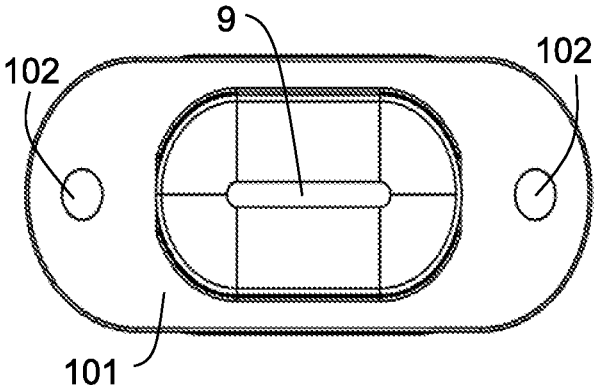
FIG. 18A is a view from the rear end.
Figure 18B:
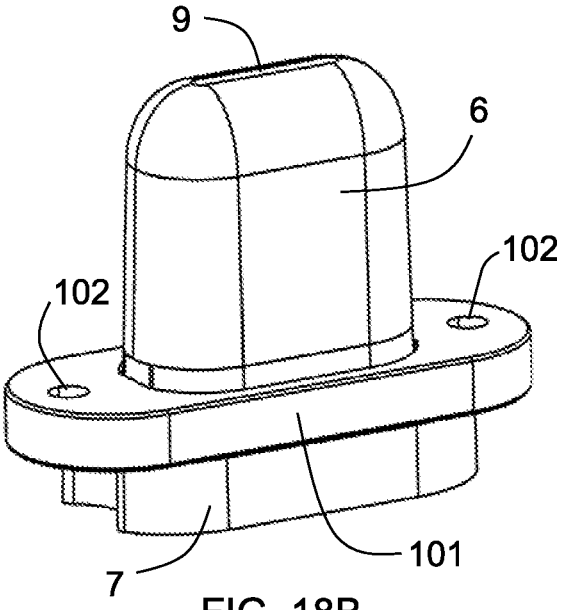
FIG. 18B is a perspective view and FIG. 18C is a view from the front end.
Figure 18C:
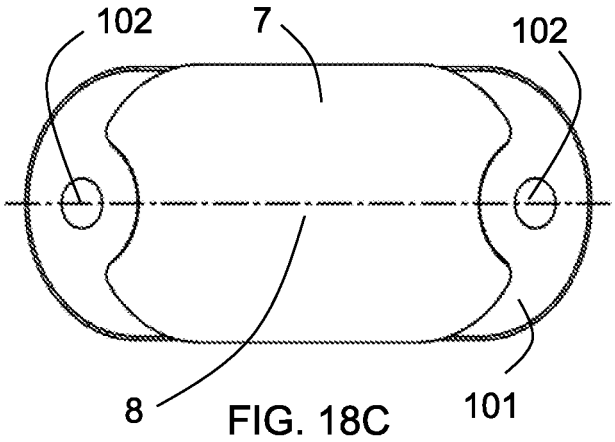

The FIGS. 18A, 18B and 18C show an alternative embodiment to the one shown in the FIGS. 17A, 17B and 17C. In the case of this embodiment, the metal washer is wider than in the previous embodiment and the flange 7 does not extend over said threaded through holes 102, instead, the shape of the flange 7 is truncated in its ends in order to avoid covering the threaded through holes 102.

The invention claimed is:

1. A capsule for protecting an electronic device inside a wear element of an earth moving machine, having a central axis defining an axial direction, a front end, and a rear end opposite said front end in the axial direction;

said capsule comprises:

a container, extending in the axial direction from said front end, provided with an inner chamber configured for housing said electronic device, wherein said container has a front part provided with a flange, and a rear part; and a cover that can be removably coupled to said container and configured for covering said rear part of said container wherein said container and said cover are configured so that when said cover is coupled to said container said cover is spaced from said flange wherein the container comprises a wall part provided in the spacing between the rear end of the flange and the cover.

2. The capsule according to claim 1, wherein said flange has extraction means configured for extracting said container from said wear element by means of pushing in the axial direction.

3. The capsule according to claim 2, wherein said extraction means comprise at least two threaded through holes.

4. The capsule according to claim 3, wherein said threaded holes are arranged in the axial direction, parallel to said central axis.

5. The capsule according to claim 4, wherein said threaded holes are all arranged at the same distance from said central axis separated from one another at regular intervals.

6. The capsule according to claim 1, wherein said container is open at its rear end.

7. The capsule according to claim 1, wherein the capsule has a diameter with respect to said central axis that decreases between said front end and said rear end, said capsule having a frustum shape or a frustoconical shape.

8. The capsule according to claim 1, wherein the capsule further comprises a first positioning means configured for cooperating with respective positioning means of said wear element for positioning said capsule inside said wear element.

9. The capsule according to claim 8, wherein said first positioning means are provided on said flange.

10. The capsule according to claim 1, wherein the capsule further comprises a second positioning means configured for cooperating with respective positioning means of said electronic device for positioning said electronic device inside said capsule.

11. The capsule according to claim 1, wherein the capsule further comprises a capsule fixing means configured for fixing said capsule to said wear element.

12. The capsule according to claim 11, wherein said capsule fixing means comprises a plurality of projections provided on the perimeter of said flange.

13. The capsule according to claim 1, wherein the capsule is manufactured in a polymer material.

14. The capsule according to claim 13, wherein said material has a water absorption of less than 10% measured according to the norm ISO 62:2008 published on February 2008.

15. The capsule according to claim 13, wherein said material has a moisture absorption of less than 4% measured according to the norm ISO 62:2008 published on February 2008.

16. The capsule according to claim 13, wherein said material has a dielectric constant equal or less than 5.

17. The capsule according to claim 13, wherein said material has a dielectric loss coefficient equal or less than 0.03.

18. The capsule according to claim 13, wherein said material comprises at least one of the list consisting in:

polyamide 6, PA6;

polyamide 6.6, PA6.6 polyether ether ketone, PEEK; and polyphenylene sulfide, PPS.

19. The capsule according to claim 13, wherein said material further comprises a glass fiber filler.

20. The capsule according to claim 1, wherein said container and said cover are configured so that when said cover is coupled to said container said cover covers said container up to the rear end of said flange.

21. The capsule according to claim 1, wherein said rear part is an oval base frustum.

22. The capsule according to claim 1, wherein said flange is an oval base frustum.

23. A capsule for protecting an electronic device inside a wear element of an earth moving machine, having a central axis defining an axial direction, a front end, and a rear end opposite said front end in the axial direction; said capsule comprises:

a container, extending in the axial direction from said front end, provided with an inner chamber configured for housing said electronic device, wherein said container has a front part provided with a flange, and a rear part; and a cover that can be removably coupled to said container and configured for covering said rear part of said container wherein the capsule further comprises a metal washer arranged at the rear end of said flange, so that said metal washer is interposed between said flange and said wear element when said capsule is inserted in said wear element; said washer having at least two threaded through holes and said flange extends over said threaded through holes, said flange provided with corresponding access holes for accessing said threaded through holes from the front end of said flange.

24. The capsule according to claim 23, wherein said flange does not extend over said threaded through holes.

25. A wear element comprising an electronic device protected by the capsule according to claim 1.

26. An earth moving machine comprising at least one wear element according to claim 25.

* * * * *